United States Patent [19]

Mlinar et al.

[11] Patent Number: 4,604,590

[45] Date of Patent: Aug. 5, 1986

[54] MICROSTRIP CIRCULATOR STRUCTURE

[75] Inventors: Mitchell J. Mlinar; Kenneth Louie, both of Torrance; Wieslaw S. Piotrowski, Los Angeles, all of Calif.

[73] Assignee: TRW Inc., Redondo Beach, Calif.

[21] Appl. No.: 643,924

[22] Filed: Aug. 24, 1984

[51] Int. Cl.[4] ..... H01P 1/387

[52] U.S. Cl. ..... 333/1.1; 333/33

[58] Field of Search ..... 333/1.1

[56] References Cited

U.S. PATENT DOCUMENTS

| | | | |
|---|---|---|---|
| 3,085,212 | 4/1963 | Clark et al. | 333/1.1 |
| 3,456,213 | 7/1969 | Hershenov | 333/1.1 |
| 3,467,918 | 9/1969 | Dunn et al. | 333/1.1 |
| 3,758,878 | 9/1973 | Wainwright | 333/1.1 |

*Primary Examiner*—Paul Gensler

*Attorney, Agent, or Firm*—Robert M. Wallace; Noel F. Heal

[57] ABSTRACT

A microstrip circulator having good matching properties in the millimeter communications band. Each of three microstrip lines is shaped to interface with a metalized ferrite element in such a manner as to provide both electrical impedance matching and a contact angle with the ferrite that satisfies the magnetic coupling requirements. The end of each microstrip includes a first arcuate portion contacting the ferrite over a relatively small contact angle, to provide tangential launching of energy and good coupling properties, and a second arcuate portion spaced apart from the ferrite to allow magnetic coupling and appropriate electrical impedance matching.

4 Claims, 4 Drawing Figures

MICROSTRIP CIRCULATOR STRUCTURE

BACKGROUND OF THE INVENTION

This invention relates generally to ferrite circulators used in microwave circuitry, and more particularly, to ferrite circulators for coupling microwave electromagnetic energy between microstrip lines. The principles of ferrite circulators are well known, and documented in a number of texts, for example, "Microwave Ferrites and Ferrimagnetics," by Benjamin Lax and Kenneth J. Button, published by McGraw-Hill (1962).

In a three-port ferrite circulator, there are three transmission paths spaced radially about a generally cylindrical ferrite element subject to an appropriate magnetic field. Electromagnetic energy transmitted toward the ferrite element along a first path is transmitted out along the next adjacent path, spaced 120° from the first. The transmission paths may be electromagnetic waveguides, or may be microstrip lines consisting of a metallic strip spaced from a ground plane by a dielectric layer.

Circulators have wide application in very-high-frequency communications systems. In particular, there are increasing numbers of communications systems and subsystems being produced using integrated circuits for operation in the millimeter-wave communications frequency band. At frequencies above 20 gigahertz (GHz), there has been a critical problem in developing such circuits because of the lack of an acceptable circulator.

The principal difficulty encountered in producing an acceptable circulator for use with microstrip lines at these high frequencies is the difficulty of matching the microstrip lines to the ferrite. Electrical impedance matching dictates that a relatively wide microstrip line be used, to match the relatively low impedance of the ferrite. However, use of a wide microstrip line results in a substantial mismatch in magnetic coupling properties of the microstrip lines and the ferrite. If the microstrip lines are appropriately matched with the ferrite to provide the proper coupling angle, by using relatively narrow microstrip lines, there is a serious mismatch in electrical impedances.

Prior to this invention, no circulators of the prior art had successfully addressed this problem. Other circulators have provided proper electrical impedance matching over a narrow range of frequencies, and a proper coupling angle with the ferrite such that desired performance is obtained over a different narrow range of frequencies. However, prior to this invention it has not been possible to provide proper coupling with the ferrite in a structure that also provides electrical impedance matching over a common wide range of frequencies. Some attempts to solve this problem have focused on making changes to the ferrite properties, or to its size, to minimize the degree of mismatch, but none has been successful.

It will be appreciated from the foregoing that there has been a need for a microstrip circulator structure that provides for both magnetic and electrical matching of the microstrip lines to the ferrite element. The present invention achieves this end and is well suited for fabrication using integrated circuit techniques.

SUMMARY OF THE INVENTION

The present invention resides in an arrangement of microstrip lines and a ferrite circulator, to achieve both a proper coupling angle and electrical impedance matching between the microstrip lines and the ferrite.

Briefly, and in general terms, the invention comprises a metalized ferrite element and a plurality of radially oriented microstrip lines, the ends of the microstrip lines adjacent to the ferrite being shaped to achieve magnetic and electrical matching. Specifically, the end of each microstrip line includes a first arcuate portion in contact with the metalized ferrite, to provide a desirably low coupling angle with the ferrite, and a second arcuate portion spaced from the ferrite, but sufficiently close to provide for magnetic coupling between the microstrip and the ferrite over a relatively wide angle, and thereby meeting the impedance matching requirement. In brief, the novel structure provides a relatively narrow contact angle to achieve proper coupling with the ferrite, and a relatively wide microstrip structure that comes sufficiently close to the ferrite to provide a low electrical impedance to match that of the ferrite.

Although the specific dimensions of the microstrip will depend on the design goals of the device, particularly the frequency range, in general the gap between the ferrite and the second arcuate portion of the end of each microstrip line should not be more than about twenty-five percent of the ferrite diameter. Other aspects and advantages of the invention will become apparent from the following more detailed description, taken in conjunction with the accompanying drawings.

DESCRIPTION OF THE PREFERRED EMBODIMENT

Figure 1:
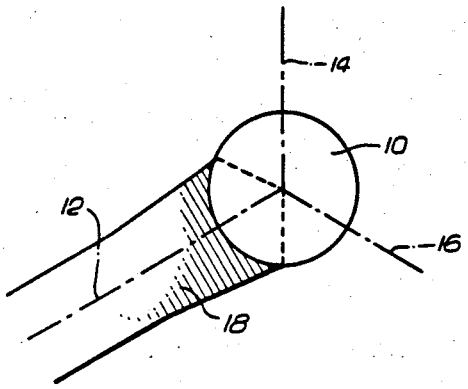
FIG. 1 PRIOR ART
FIG. 1 is a fragmentary diagrammatic plan view of a microstrip ferrite circulator of the prior art.

As shown in the drawings for purposes of illustration, the present invention is concerned with ferrite circulators for use with microstrip transmission lines. In the past, microstrip lines have been matched to ferrite circulators by one or the other of the techniques shown in FIGS. 1 and 2.

In the structure shown in FIG. 1, a ferrite element, indicated by reference numeral 10, is used as a circulator in conjunction with three ports 12, 14 and 16, indicated diagrammatically by broken lines spaced 120° apart. One of the ports 12 is shown to include the outline of a microstrip transmission line 18, the other two lines being omitted for clarity.

Figure 4:
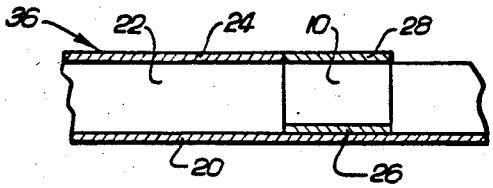
FIG. 4 is a fragmentary cross-sectional view of the circulator of FIG. 1.

The structure of the microstrip transmission line is indicated in FIG. 4. Basically, it includes a metalized ground plane 20 formed on one face of a sheet 22 of dielectric material, such as Duroid, and a metal strip 24 on the opposite face of the dielectric sheet.

In a typical microstrip ferrite circulator structure, the ferrite element 10 is recessed into the dielectric sheet 22, is generally cylindrical in shape, and is metalized on both flat ends, as indicated at 26 and 28. The lower metalized end 26 makes contact with the ground plane 20, and the upper metalized end 28 is contacted by the metal strip 24 of the microstrip line.

The microstrip line 18 in FIG. 1 is widened along the surface of contact with the circumference of the ferrite 10, to provide a relatively low electrical impedance, matching that of the ferrite, resulting in a relatively wide contact angle A. Unfortunately, however, the properties of the ferrite 10 dictate that a much smaller contact angle is needed to provide proper coupling to and operation of the circulator. In the configuration of FIG. 1, the large contact angle A results in improper magnetic coupling with the ferrite. The device operates only over a narrow bandwidth, and with unacceptable energy reflection and insertion loss.

Figure 2:
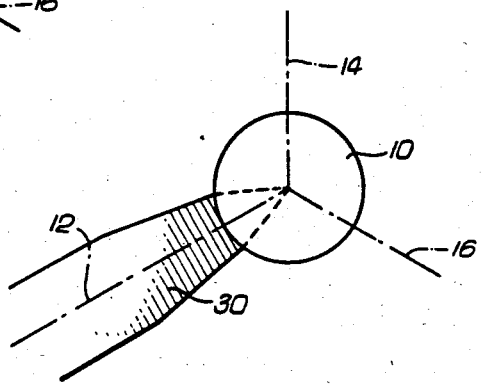
FIG. 2 PRIOR ART
FIG. 2 is a fragmentary diagrammatic plan view of another microstrip ferrite circulator of the prior art.

FIG. 2 illustrates another approach to solving the matching problem. The microstrip upper layer, indicated at 30, is tapered to provide a small contact angle B to match the magnetic coupling requirements of the ferrite 10. However, the reduced cross section of the microstrip results in a larger electrical impedance, which is mismatched with that of the ferrite.

Figure 3:
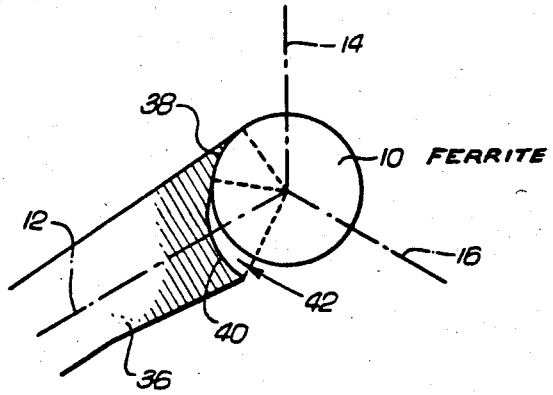
FIG. 3 is a fragmentary diagrammatic plan view of the microstrip ferrite circulator of the invention.

In accordance with the invention, and as shown in FIG. 3, each microstrip line, indicated at 36, is appropriately widened at its end to provide a relatively small impedance, but contacts the ferrite 10 over a relatively small contact angle C, to meet the magnetic coupling requirements of the ferrite. More specifically, the end of the microstrip metal 36 is shaped to include a first arcuate portion 38 beginning at one edge of the metal, and with a radius matching that of the ferrite 10. This arcuate portion 38 provides the needed relatively small contact angle with the ferrite, and launches energy tangentially into the ferrite, minimizing losses from energy reflection.

The end of the metal layer 36 is completed by a second arcuate portion 40 contiguous with the first portion 38 and having a curvature that departs from the periphery of the ferrite and thereby forms a small gap 42 between the microstrip metal 36 and the ferrite 10. Energy is coupled magnetically across the gap 42, and the ferrite "sees" an effective impedance of the microstrip equivalent to the total angle of the strip subtended at the center of the ferrite.

The gap 42 should be small enough not to present a large magnetic reluctance to the flow of energy. Experimental data indicates that a gap of more than twenty-five percent of the ferrite diameter results in poor impedance matching and reduces the effectiveness of the device.

In adapting the invention for use in a particular application, one must first determine the contact angle, between microstrip and ferrite, that is dictated by the desired range of frequencies and a selected ferrite. This will be determinative of the angular size of the first arcuate portion 38 of each microstrip end. The electrical impedance of the ferrite will determine the total angular size of the microstrip end, and therefore the angular size of the second arcuate portion 40. It will be understood that the structure described for one microstrip arm of the circulator is repeated identically in the other two arms of the device. The resulting circulator structure provides a matched interface between the microstrip lines and the ferrite, satisfying both the coupling requirements and the impedance matching requirements of the ferrite, over a relatively wide range of frequencies.

It will be appreciated from the foregoing that the present invention represents a significant advance in the field of microstrip circulators. In particular, the invention provides a microstrip structure that can be closely matched to the ferrite circulator's coupling requirements and electrical impedance, over a relatively wide range of frequencies. Moreover, the microstrip configuration of the invention is well suited for fabrication using integrated circuit techniques.

It will also be appreciated that, although a specific embodiment of the invention has been described in detail for purposes of illustration, various modifications may be made without departing from the spirit and scope of the invention. Accordingly, the invention is not to be limited except as by the appended claims.

We claim:

1. A microstrip circulator structure, comprising:

a metalized ferrite element of generally cylindrical shape; and a plurality of microstrip transmission lines, radially oriented with respect to the ferrite, the ends of the microstrip lines adjacent to the ferrite being shaped to achieve magnetic and electrical matching over a wide range of frequencies, and wherein the end of each microstrip line includes a first arcuate portion extending from one edge of the microstrip line, to provide for tangential launching of energy into the ferrite, and in contact with the metalized ferrite, to provide a desirably low coupling angle with the ferrite, and a second arcuate portion contiguous with the first, and spaced from the ferrite, but sufficiently close to provide for magnetic coupling between the microstrip and the ferrite over a relatively wide angle, and thereby meeting its impedance matching requirements.

2. A structure as set forth in claim 1, wherein:

the second arcuate portion of the end of each microstrip line is spaced from the ferrite by no more than twenty-five percent of the ferrite diameter.

3. A microstrip circulator structure, comprising:

a sheet of dielectric material having a conductive ground plane on one face;

a ferrite element embedded in the dielectric sheet, the ferrite element being generally cylindrical and having first and second metalized end faces, the first end face being in contact with the ground plane; and three metalized strips formed on the other face of the dielectric surface and forming microstrip transmission lines with the dielectric material and the ground plane, the three strips being disposed radially with respect to the ferrite element, and spaced at equal angles apart to form the input-output arms of the circulator;

wherein each of the strips has its end closest to the ferrite element shaped to provide a desired coupling angle with the ferrite element and to provide simultaneously an impedance matching that of the ferrite element;

and wherein the end of each strip includes a first arcuate portion located at one edge of the strip and in edge contact with the second metalized face of the ferrite element, to provide for tangential launching of energy into the ferrite and to provide a desirably low coupling angle with the ferrite element, and a second arcuate portion spaced from the ferrite element, but sufficiently close to provide for magnetic coupling between the microstrip line and the ferrite element over a relatively wide angle, and thereby meeting its impedance matching requirements.

4. A structure as set forth in claim 3, wherein:

the second arcuate portion of the end of each strip is spaced from the ferrite element by no more than twenty-five percent of the ferrite element diameter.

* * * * *